US007128382B2

(12) United States Patent
Velde

(10) Patent No.: US 7,128,382 B2
(45) Date of Patent: Oct. 31, 2006

(54) CALIBRATION OF A MULTILEVEL INKJET PROCESS

(75) Inventor: Koen Vande Velde, Duffel (BE)

(73) Assignee: Agfa- Gevaert N.V, Mortsel (BE)

( * ) Notice: Subject to any disclaimer, the term of this patent is extended or adjusted under 35 U.S.C. 154(b) by 601 days.

(21) Appl. No.: 10/654,688

(22) Filed: Sep. 4, 2003

(65) Prior Publication Data

US 2004/0046818 A1 Mar. 11, 2004

Related U.S. Application Data

(60) Provisional application No. 60/413,501, filed on Sep. 25, 2002.

(30) Foreign Application Priority Data

Sep. 6, 2002 (EP) ..... 02102316

(51) Int. Cl.
*B41J 29/38* (2006.01)

(52) U.S. Cl. ..... 347/14; 347/19

(58) Field of Classification Search ..... None
See application file for complete search history.

(56) References Cited

U.S. PATENT DOCUMENTS 4,561,025 A 12/1985 Tsuzuki
5,276,459 A * 1/1994 Danzuka et al. ..... 346/33 A
6,390,583 B1 5/2002 Kato et al.
2001/0035889 A1 11/2001 Mikami
2002/0021321 A1 2/2002 Nakajima et al.
2004/0141193 A1* 7/2004 Mestha ..... 358/1.9

FOREIGN PATENT DOCUMENTS

EP 02 10 2316 11/2002

* cited by examiner

*Primary Examiner*—Thinh Nguyen
(74) *Attorney, Agent, or Firm*—Robert A. Sabourin

(57) ABSTRACT

A multilevel printing process can be calibrated by: measuring a small number of recorded patches obtaining data points characterising the printing process, modeling a gradation of the printing process with a model curve incorporating different gradation behaviour of the printing process in different regimes based upon the obtained data points, and using the model curve to obtain a gradation-correction curve for calibrating the printing process, where it is sufficient to use only patches obtained by filling every pixel in a patch with a same recording level.

6 Claims, 1 Drawing Sheet

CALIBRATION OF A MULTILEVEL INKJET PROCESS

The application claims the benefit of U.S. Provisional Application No. 60/413,501 filed Sep. 25, 2002.

FIELD OF THE INVENTION

The present invention relates to a method for calibrating an inkjet printing process. More specifically the invention is related to gradation compensation of a multilevel inkjet process.

BACKGROUND OF THE INVENTION

Nowadays a lot of printed matter is produced carrying a reproduction of a black and white or colour image. A large part of these prints are produced using offset printing but in office and home environment a lot of prints are made using relatively small printing apparatuses.

Possible types of printers are typically laser printers using an electrographic process, thermal printers and inkjet printers.

Older printers were only capable of recording one type or size of dot, a dot of colorant was either absent or present. These types use so-called binary printing processes.

Recently apparatuses are capable of reproducing several sizes or densities of dots for each colorant. Such a printer uses a multilevel process. An example of this type of printer is an inkjet printer capable of jetting drops of different sizes or a variable number of drops on to of each other onto a substrate resulting in different dot sizes. Another method is making use of different inks having the same colour but different densities (e.g. light and dark magenta inks or black and grey inks).

Also a combination of the two methods (different densities/different drop sizes) is used (U.S. Pat. No. 5,975,671 by Spaulding et al.).

Printing processes seldom behave linearly, i.e. there is no linear relationship between the electronic level of the pixels to be applied and the optical density of the printed pixel. In order to obtain a good representation of the image to be printed the printing process has to be calibrated in advance.

By calibration of a printing process we mean the calculation and application of a gradation compensation curve for each of the colorants, to bring the gradation to a standard and stable state.

Following considerations regarding a multilevel inkjet printing process can be made. Reference is made to FIG. 1.

In a K-level printing process, K basic tone levels exist. These basic tone levels may arise from printing with dots of multiple sizes, from using inks with different densities but substantially the same hue, or from a combination of both. We indicate the K different levels by L1, L2, . . . , LK. The resulting basic tone levels are indicated by T1, T2, . . . , TK, i.e. a patch of tone Ti is formed by laying down level Li at each pixel in the patch.

Intermediate tone levels are created by a multilevel halftone procedure.

From the point of view of graininess, it is preferable to form a tone level situated between Ti and Ti+1, by a mixture of pixels having level Li and pixels having level Li+1 only.

The printing process is naturally divided into several regimes:

the regime where pixels of level L1=white are mixed with pixels of level L2, the regime where pixels of level L2 are mixed with pixels of level L3, etc.

By a regime we understand a part of the tone scale printed with a mixture of a specific set of (two) levels.

To take a specific example, consider an inkjet printing process able to deliver two drop sizes. In the first half of the tone scale small dots are placed with white spaces in between until all pixels are filled with the small dots. In the second half of the tone scale, the small dots are replaced at some pixels by large dots. At the darkest tone, all pixels are filled with large dots. FIG. 1 shows the density as a function of the tone level for such a process. At the border of the two regimes (i.e. at the tone T2) we see an un-smooth behaviour of the gradation, a nod as illustrated in FIG. 1.

The density behaviour between T1 and T2 is substantially linear if we increase the percentage of pixels filled with small dots in a linear way with the tone level. The density behaviour between T2 and T3 is also substantially linear although it may deviate from linearity at the darker tones due to dot overlaps (depicted by the dotted line in FIG. 1).

The nod at T2 is noticeable as an abrupt change or a contour in a slowly varying image portion. Although the print process is continuous at the point, its gradation is not smooth and our eyes is are sensitive to it.

In the calibration process, we want to bring the process to a standard state, characterised by a predefined smooth gradation curve. Since the process is un-smooth itself, the only way to bring it to a smooth gradation curve is to apply an un-smooth correction. The current method aims to model the gradation of the printing process by a piecewise smooth curve and to correct the process with a piecewise smooth gradation-correction curve to bring it to a predefined smooth target curve.

Traditional calibration methods try to model the measured data with an overall smooth curve, to produce an overall smooth gradation-correction curve. This will never yield satisfactory results if the printing process is un-smooth itself.

SUMMARY OF THE INVENTION

The above-mentioned advantageous effects are realised by a method having the specific features set out in claim 1. Specific features for preferred embodiments of the invention are set out in the dependent claims.

Further advantages and embodiments of the present invention will become apparent from the following description and drawings.

DETAILED DESCRIPTION OF THE INVENTION

While the present invention will hereinafter be described in connection with preferred embodiments thereof, it will be understood that it is not intended to limit the invention to those embodiments.

As described in the example above, it is the optical density that is expected to behave in a piecewise linear way for pure multi-droplet sized processes. Therefore optical density is the quantity used to model the process.

In a first step data is collected through measurement of optical densities. We measure the optical density of the different basic tone levels. To this end a small number of K−1 patches are printed and measured:

Patch 1: all pixels are filled with a droplet of the smallest size.

Patch 2: all pixels are filled with a droplet of the second smallest size.

Patch . . .

Patch K−1: all pixels are filled with the largest dot size.

This way data points for the process are obtained.

Preferably only patches obtained by filling every pixel in the patch with the same recording level are used.

The recording levels can correspond to different drop sizes as above but also e.g. drop count can be used.

Figure 1:
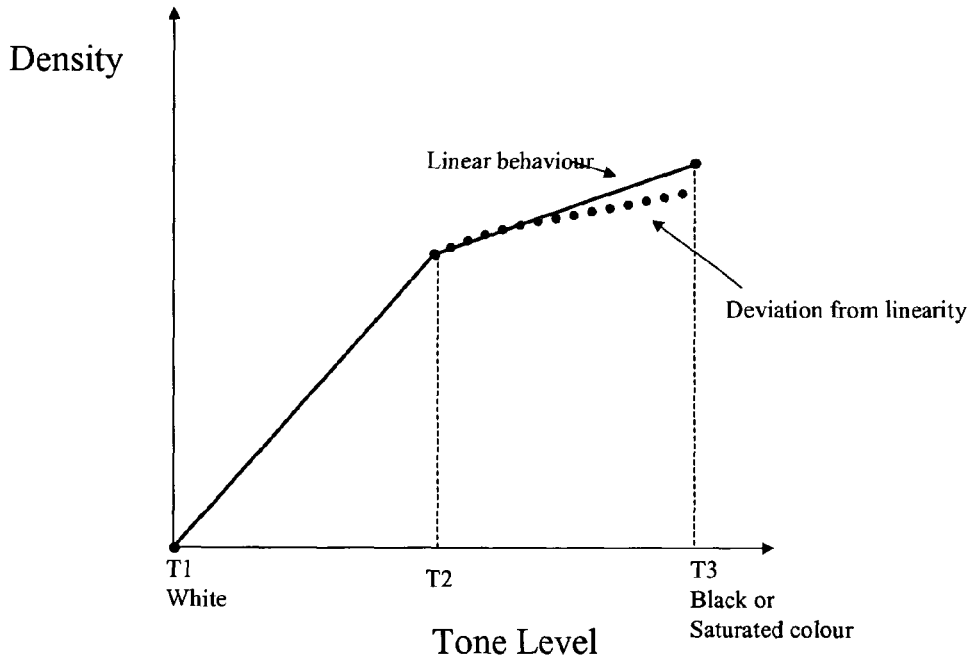
FIG. 1 shows gradation curve for a 3-level process.

In a second step the density of the printing process over the whole tone scale is modelled by connecting the measurement data points by straight lines. At this point the tone level Ti corresponding to level Li is equal to (i−1)/(K−1). In the example of FIG. 1, T2 is placed on the tone scale in the middle between T1 and T3.

The obtained model curve based upon said data points incorporates the different gradation behaviour or the process in its different regimes.

The model curve can be obtained by linear interpolation in between the obtained data points from the measured patches. Other methods can be used.

In a third step a gradation-correction curve is obtained for calibrating the process. After modelling the densities may be converted to another quantity, depending on the definition of the target gradation (dot percentage, luminance, lightness, . . . . The gradation expressed in this new quantity is no longer a piecewise linear, but still a piecewise smooth curve, possibly having nod points at the points Ti.

Denoting the piecewise model curve by m(x), and the smooth target curve by t(x), the gradation correction is obtained as $g(x)=t(m^{-1}(x))$.

Better calibration results in terms of smoothly varying gradation are obtained by the combination of a few linear curve based on the measurement of the basic tone levels, than from linear interpolation based on a lot of measurements. In this last case measurement errors ripple through to the gradation correction, resulting often in a wobbly tone correction curve, introducing additional banding instead of removing the banding.

When the density behaviour deviates to hard from linearity in the upper part of the tone scale, as sketched by the dotted line in FIG. 1, it is preferable to include an additional measurement in the data. In that case we measure a patch with a tone T2+ situated between T2 and T3, but near T2 (e.g. 95% dots of L2 and 5% dots of L3). In that case we fit a polynomial function through the measurements T2, T2+, and T3 and replace the straight line by this polynomial. We may also use other functions depending on a few parameters instead of polynomials e.g. to guarantee monotonousness. An example is the function $a-(b-x)^{\gamma}$ (a, b, γ are the parameters).

Another case where a simple linear behaviour is not guaranteed is a multilevel printing process where the levels are made of combinations of different dot sizes and ink densities.

An example: a printer uses 2 cyan inks, light cyan (lc) and dark cyan (dc), each producible in three drop sizes 1, 2, 3. Densities measured on paper are

| |
|---|
| lc1: 0.40, lc2: 0.65, lc3: 0.93 |
| dc1: 0.84, dc2: 1.40, dc3: 1.88 |

From this a 6-level cyan printing process is build having levels L1=white paper, L2=lc1, L3=lc2, L4=lc3, L5=dc2, L6=dc3.

Figure 2:
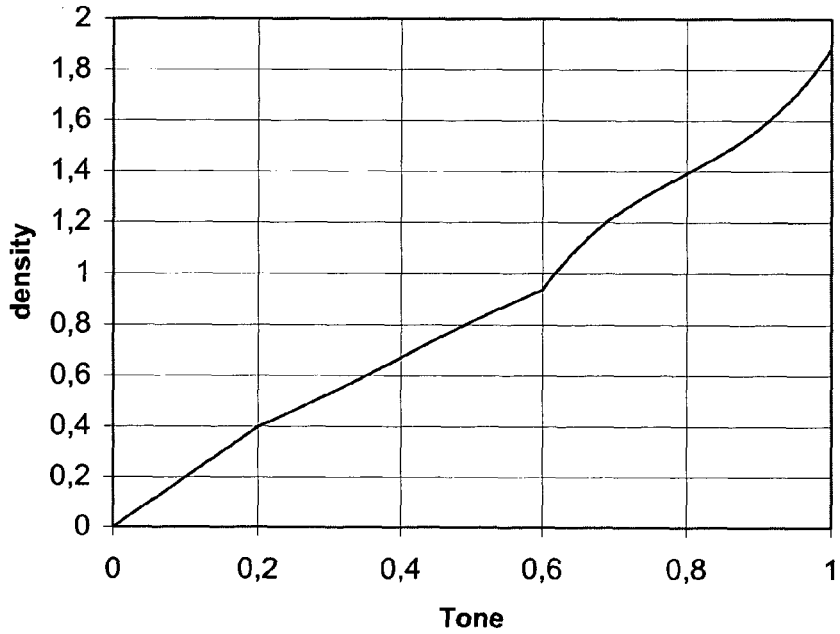
FIG. 2 shows a model for a 6-level printing process using two ink densities and three dot sizes. T1=0, T2=0.2, T3=0.4, T4=0.6, T5=0.8, T6=1.

Experiments show that the process can be modelled by piecewise linear curves between T1 and T2, T2 and T3, and T3 and T4. The change from dot lc3 to dot dc2 is more complex since both ink density and dot size are changed at that point. A measurement at the tone T4+=96% lc3 and 4% dc2 reveals that the density is actually higher than expected from a linear interpolation. Good calibration results were obtained with a model having linear pieces between T1 and T2, T2 and T3, and T3 and T4, and a third order polynomial fitted through the measurements T4, T4+, T5 and T6. This model is displayed in FIG. 2.

The method of the present invention can easily be expanded to colour systems.

In a colour recording process a colour image is represented by sub-images of different colour printed in register. One of the most popular systems is by printing using a CMYK system. Images having cyan, magenta, yellow and black ink are printed in register on top of each other. When using e.g. and inkjet system capable of multilevel recording, calibration for each of the colours can be performed using the method of the invention. As an alternative not all colour need to be calibrated using a method according to the present invention.

Having described in detail preferred embodiments of the current invention, it will now be apparent to those skilled in the art that numerous modifications can be made therein without departing from the scope of the invention as defined in the appending claims.

The invention claimed is:

1. A method for calibrating a multilevel printing process, comprising the steps of:

measuring an optical density or colour of a small number of recorded patches obtaining data points for the printing process, modelling a gradation of the printing process with a model curve incorporating different gradation behaviour of the printing process in different regimes based upon said data points, using the model curve to obtain a gradation-correction curve for calibrating the printing process, characterised in that the measured patches substantially comprise only patches obtained by filling every pixel with a same recording level.

2. Method according to claim 1 wherein said measured patches comprise only patches obtained by filling every pixel in the patch with the same recording level.

3. Method according to claim 1 wherein the model curve is obtained by linear interpolation in between the data points obtained by measuring said patches.

4. Method according to claim 1 wherein the multilevel printing process is an inkiet printing process.

5. Method according to claim 4 wherein recording levels correspond to drops of different drop sizes.

6. Method according to claim 4 wherein recording levels correspond to different drop counts.

* * * * *